US006079334A

United States Patent [19]

Roheim

[11] Patent Number: 6,079,334

[45] Date of Patent: Jun. 27, 2000

[54] GRENADE FOR A GRENADE THROWER

[75] Inventor: Karl-Axel Roheim, Nynäshamn, Sweden

[73] Assignee: Roheim System, Nynashamn, Sweden

[21] Appl. No.: 09/117,686

[22] PCT Filed: Jan. 29, 1997

[86] PCT No.: PCT/SE97/00139

§ 371 Date: Aug. 3, 1998

§ 102(e) Date: Aug. 3, 1998

[87] PCT Pub. No.: WO97/30324

PCT Pub. Date: Aug. 21, 1997

[30] Foreign Application Priority Data

Feb. 14, 1996 [SE] Sweden ..... 9600543

[51] Int. Cl.[7] ..... F42B 25/00

[52] U.S. Cl. ..... 102/394; 102/404; 102/373; 102/382

[58] Field of Search ..... 102/372, 373, 102/404, 394, 382

[56] References Cited

U.S. PATENT DOCUMENTS

| | | | |
|---|---|---|---|
| 2,657,630 | 11/1953 | Blacker | 102/372 |
| 3,552,326 | 1/1971 | Howe | 102/394 |
| 3,808,972 | 5/1974 | Cammack et al. | 102/394 |
| 3,968,748 | 7/1976 | Burford et al. | 102/394 |
| 4,593,620 | 6/1986 | Pettersson et al. | 102/372 |
| 4,611,540 | 9/1986 | Pettersson et al. | 102/372 |
| 4,665,825 | 5/1987 | Pettersson | 102/372 |
| 4,694,755 | 9/1987 | Ibarra | 102/445 |
| 4,782,757 | 11/1988 | Carter | 102/394 |
| 5,175,393 | 12/1992 | Andersson | 102/372 X |
| 5,279,229 | 1/1994 | Bredy et al. | 102/425 |

FOREIGN PATENT DOCUMENTS 505184 7/1997 Sweden .

*Primary Examiner*—Michael J. Carone
*Assistant Examiner*—James S. Bergin
*Attorney, Agent, or Firm*—Jacobson, Price, Holman & Stern, PLLC

[57] ABSTRACT

Shell for trench mortars and similar firing systems, which shell includes an effective portion, which can be fired from a barrel by a propellant charge, there being a pressure plate provided between the effective portion and the propellant charge, which pressure plate carries the influence from the propellant charge. To provide effective fire above the ground a support portion is releasably arranged in front of the effective portion in the firing direction. The support portion carries a second propellant charge and in its front end a percussion cap, which, when the shell is fired, is located partly exposed outside the front end of the support portion and initiates the second propellant charge when hitting ground. The second propellant charge is located between the support portion and the effective portion in such a manner, that when the second propellant charge is detonated the effective portion is shot away from the support portion and simultaneously the effective charge of the effective portion is initiated with delay.

6 Claims, 4 Drawing Sheets

GRENADE FOR A GRENADE THROWER

FIELD OF THE INVENTION

This invention relates to a shell for trench mortars and a similar firing system, whereby the shell includes an effective portion, which can be fired from a barrel by a propellant charge, there being a pressure plate interposed between the propellant charge and the effective portion, which pressure plate carries the influence from the propellant charge.

BACKGROUND OF THE INVENTION

A shell of this type is previously known and described in SE 9501309-0.

SUMMARY OF THE INVENTION

The object of the present invention is to provide a shell, which explodes and delivers its effective fire in the air instead of at ground impact as previously is known. The shell can easily be reshaped into an inexpensive training shell, which is extraordinarily safe. Further, as the pressure from the propellant charge, which shoots the shell out from the barrel, is not carried by the shell itself but by the pressure plate, it is possible to use less sophisticated and cheaper material in the shell itself, which is particularly applicable to training shells.

The invention will be described schematically below on one hand and a specific embodiment thereof on the other hand.

DETAILED DESCRIPTION OF THE PREFERRED EMBODIMENTS

Figure 1:
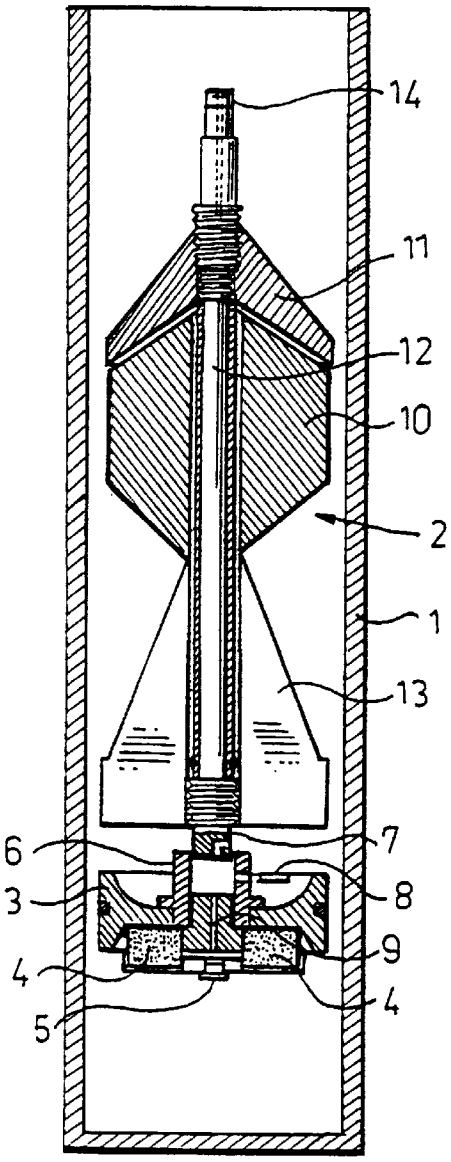
FIG. 1 shows schematically the principle of the invention with a shell inside a barrel immediately after the firing.

In FIG. 1 there is shown a barrel 1 of a trench mortar. The shell generally designated 2 is in the barrel together with the pressure plate 3. In the imaginary position shown, the pressure plate 3 has been released from the shell 2. The pressure plate 3 includes a propellant charge 4, which is located below the pressure plate and is initiated by a detonator 5. The detonator can be fired by means of a striking pin (not shown) in the bottom of the barrel. When the mortar is being loaded, the pressure plate 3 is attached to the shell 2 by a sleeve 6 of the pressure plate surrounding a stud 7 attached to the shell, the sleeve being provided with an aperture, through which a pin 8 is inserted and extends into an aperture in the stud 7. When the propellant charge 4 explodes, a portion of the gas pressure is directed through an aperture 9 to a central aperture in the stud 7, which central aperture is communicating with said aperture, through which the pin 8 is inserted, and this pressure pushes out the pin 8. Thereby the pressure plate is released from the shell 2 but accompanies the shell out from the barrel 2, but due to its much smaller weight the pressure plate falls down to the ground very soon after having left the barrel, while the shell, which has absorbed all pressure energy from the propellant charge and the pressure plate, is expelled out from the barrel.

The shell includes an effective portion 10, in which the effective charge (not shown) is located. Further, the shell includes a support portion 11, which constitutes the head portion of the shell, i.e. the portion which hits into the ground. The support portion 11 has a backing tube 12, around which the effective portion 10 with fins 13 is arranged. Thus, the effective portion 10 is applied on the backing tube 12 and is held by some kind of frictional force or equivalent. This implies, that when the pressure force of the propellant charge is released, this acts firstly on the pressure plate 3, and then the pressure action is transmitted directly onto the backing tube 12 through the stud 7, and due to frictional force between the backing tube 12 and the effective portion 10, the effective portion 10 is brought along when the support portion 11 and the backing tube 12 attached therein are fired from the barrel 1. At the firing a detonator nose 14, which is arranged in the nose of the support portion 11, is brought into the primed or unsafe position, which is described in detail below.

Figure 2:
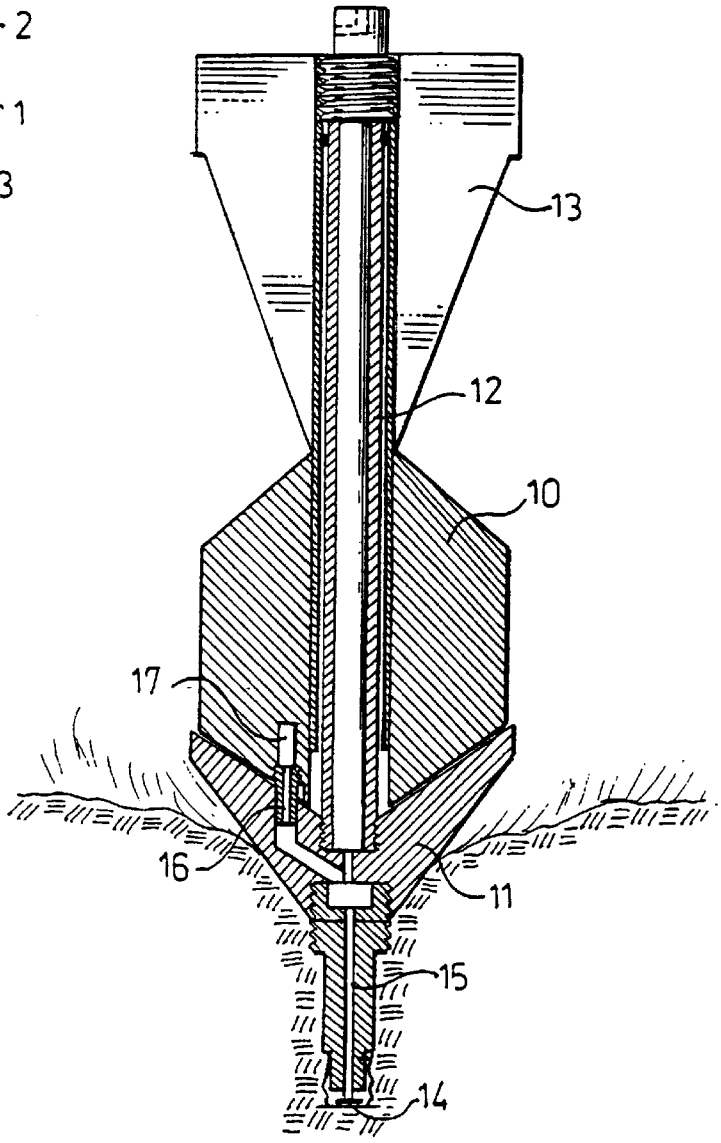
FIG. 2 shows schematically the shell after impact with the ground.

In FIG. 2 the shell is shown having hit into the ground on a certain distance from the mortar. Then the support portion 11 has hit into the ground and the detonator nose has been deformed. The detonator nose explodes and ignites a charge propagating upwards in the channel 15 and on to a second propellant charge (not shown), which is located between the support portion 11 and the effective portion 10. Further, the ignition charge propagates a fuse line 16, which is connected to an effective charge (not shown) in the effective portion 10. Thus the detonator nose 14 initiates an ignition of the second propellant charge (not shown) resulting in that the gas pressure of that charge sends away the effective portion 10 upwards from the support portion 11, which runs away from the backing tube 12. Simultaneously the fuse line 16 is ignited, which will fire the effective charge (not shown) in the effective portion 10. Thus, the burning time of the fuse line 16 determines when the effective charge is detonated in relation to when the detonator nose initiates ignition of the propellant charge; thus the effective portion 10 has reached a certain altitude above the ground before the effective charge explodes. Thus, by means of the delay thorough the fuse line it is possible to preset the altitude above the ground, at which altitude the effective portion is detonated.

Figure 3:
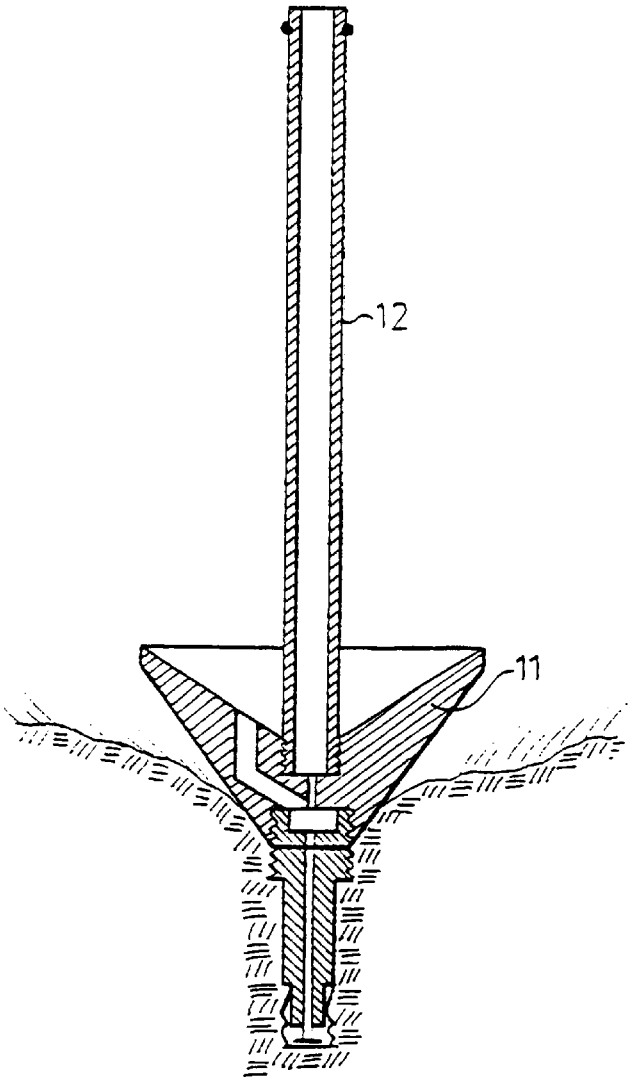
FIG. 3 shows schematically a portion of the shell in the ground after the effective component has been shot away.
Figure 4:
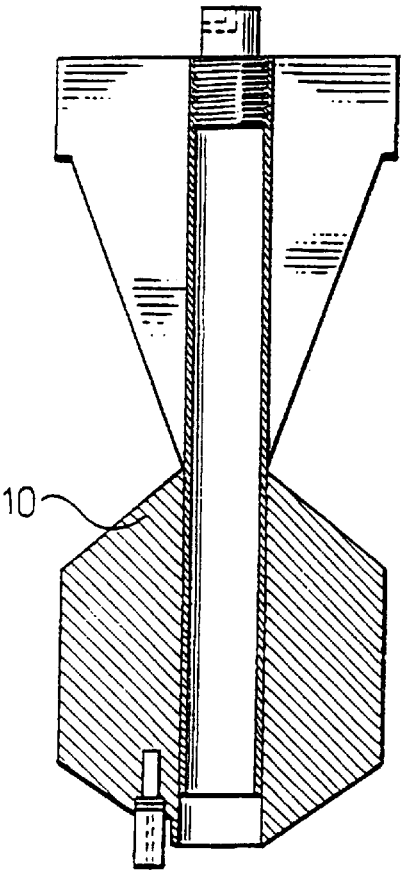
FIG. 4 shows the effective component being free from the carrier component.

FIG. 3 shows schematically how the support portion 11 remains in the ground together with the backing tube 12, and FIG. 4 shows schematically the effective portion 10 in the air.

In connection with FIGS. 1 to 4 the principle of the invention has been described but without any detailed description of the design of the support portion and the effective portion. The pressure plate has also been described in principle, but accordingly it is described in detail in the patent application No. SE 9501309-0. Below there will now be described a preferred embodiment of the shell itself without pressure plate.

Figure 5:
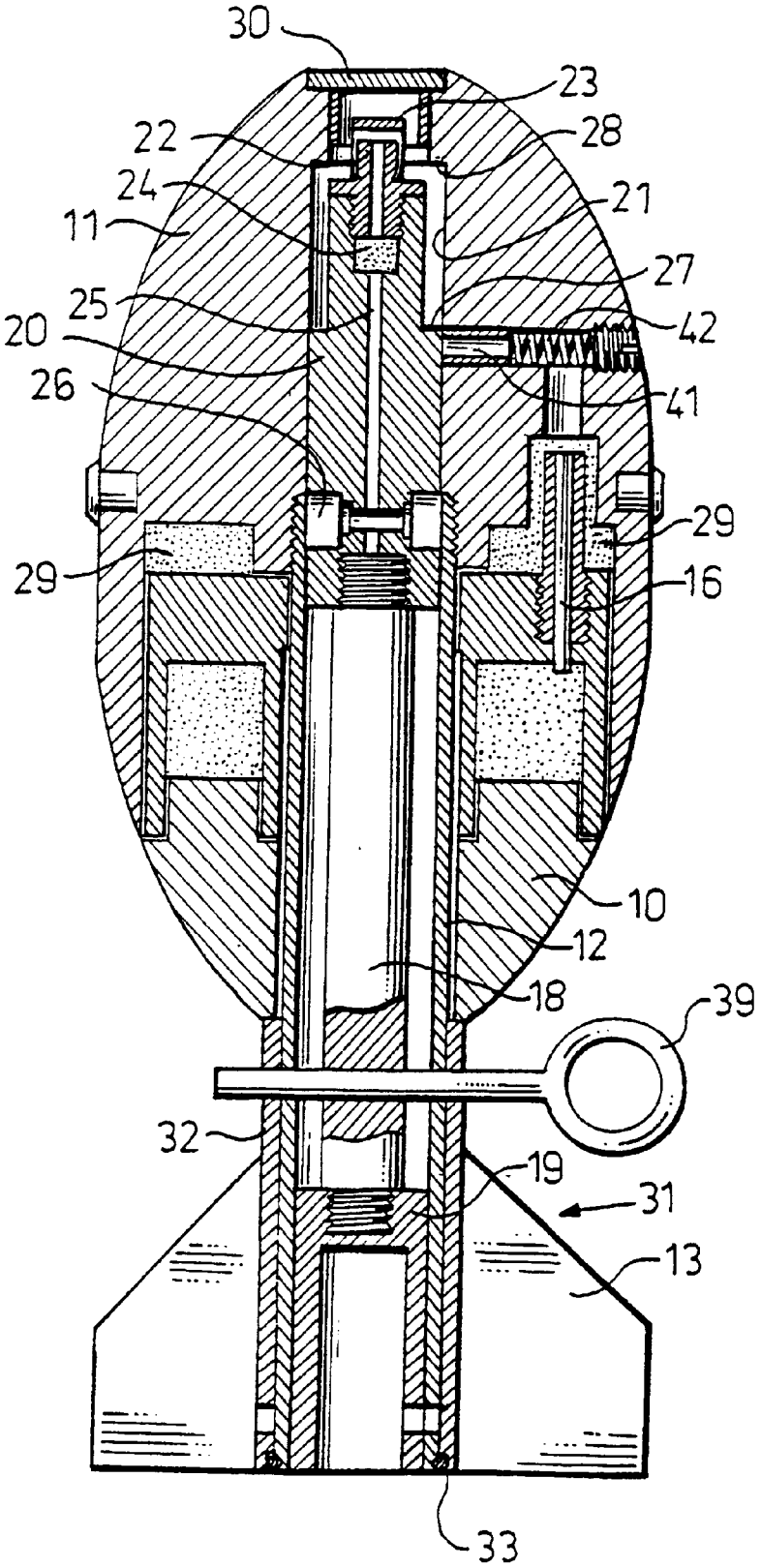
FIG. 5 shows an imaginary cross section of a preferred embodiment according to the invention of a shell, which is in safety secured state.

The preferred embodiment shown in FIG. 5 may be an actual live shell or a shell for training purposes. It is shown in a longitudinal section and in a safety secured state. The main portions corresponding to those described in connection with FIGS. 1 to 4 have the same reference numerals. Thus there is shown the effective portion 10, the support portion 11, which in FIG. 5 is located above the effective portion 10, and the backing tube 12, on which the effective portion 10 is pushed from below according to FIG. 5. The backing tube 12 is fastened to the support portion 11 by threads as is shown.

Inside the backing tube 12 there is a piston rod 18, the lower end of which is secured by treads to a piston sleeve 19, which is movable in the backing tube 12. The piston sleeve 19 is influenced from underneath by a small portion of the propellant pressure from the propellant charge of the mortar by means of a small portion of the propellant pressure passing through the pressure plate 3 (not shown in FIG. 5 but appearing in FIG. 1). Thus, the piston sleeve 19 can be pushed upwards in the backing tube 12 a certain distance, to be later described. A plunger 20 is secured by threads to the upper end of the piston rod 18. Thus the plunger 20 and the piston rod 18 move together. The plunger 20 moves with gas-sealing in a cylinder bore 21 within the support portion 11. In the tip of the plunger 20 there is a detonator means comprising a detonator fuse 22 and a detonator nose 23. Alternatively, the detonator means may comprise a striking pin replacing the detonator fuse 22 and a percussion cap replacing the detonator nose 23. When hitting the ground, the detonator fuse and the detonator nose 23 which have been displaced in front of the support portion 11, are affected when hitting the ground, whereby the detonator nose 23 is ignited. Thereby a small charge 24 will be fired. In the plunger 20 there has been bored an elongated channel 25, which extends to an annular space 26. Thus, the explosion influence from the propellant charge 24 propagates through the channel 25 to the annular space 26 and further on as will be described below more in detail.

When in a safety secured state, i.e. when the shell is transported to be loaded into the mortar, a securing sleeve 30 is arranged at the top of the support portion 11, thus protecting the detonator fuse 22. As can be seen in the drawing, the plunger 20 has an annular shoulder 27, and in an upper portion of the cylinder bore 21 of the support portion 11 there is a corresponding ledge 28. This ledge 28 restricts the movement upwards of the plunger 20 out from the support portion 11, see FIG. 6.

In the interface to the effective portion 10 the support portion 11 has a propellant charge 29. As has been mentioned previously above, this the propellant charge is initiated by the impact of the support portion, and the gas pressure from the powder charge in the propellant charge 29 results in the effective portion being shot away from the backing tube 12. This will be further described below.

In FIG. 5 there is shown a manual securing safety pin 39. Thus, the shell is safety secured during transport before it is loaded on one hand by the securing safety pin 39 and on the other hand by the securing sleeve 30. Below the effective portion 10 in FIG. 5 there is a fin portion 31 comprising the fins 13, which are arranged on a sleeve 32. The sleeve 32 extends along the backing tube 12 and is prevented from falling off by friction of an O-ring 33 at the lower end of the fin portion 31. Thus, the O-ring 33 causes the fin portion to hold the effective portion 10 abutting against the support portion 11 during the transport of the motor out of the barrel until the shell hits the ground. However, the friction force from the O-ring 33 is in no way sufficient to prevent the effective portion 10 from being shot away from the support portion 11 when the propellant charge 29 is fired.

Figure 6:
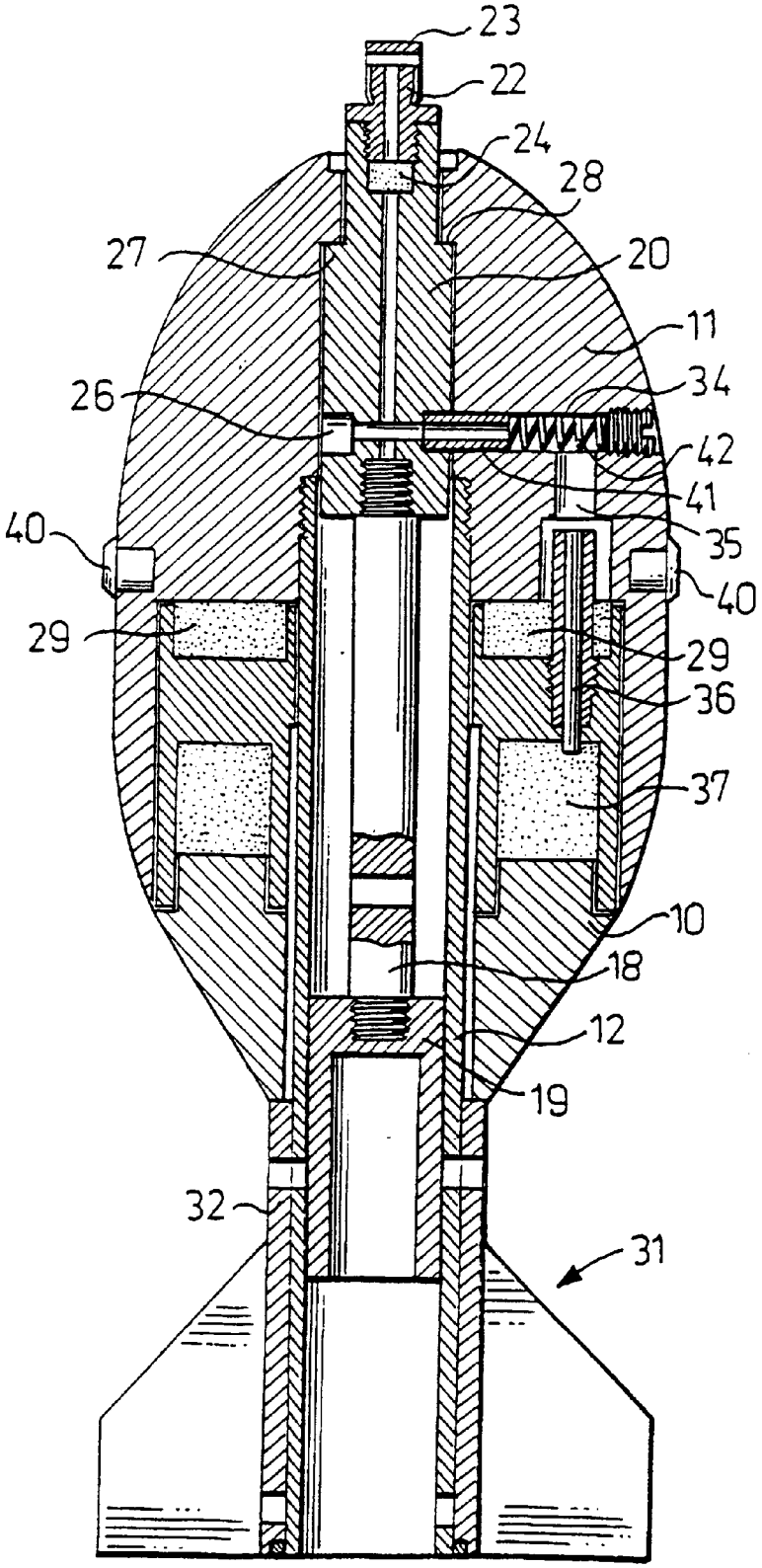
FIG. 6 is a longitudinal section of the shell according to FIG. 5 in the unsecured state after having been shot out from the barrel.

In FIG. 6 the shell is shown primed (unsecured) and in the form it leaves the barrel of the mortar. The piston arrangement comprising the piston rod 18 and the plunger 20 has been pushed forward in the support portion 11 by the gas pressure on the piston sleeve 19, so that the shoulder 27 abuts the ledge 28. Thus the propellant pressure originates from the propellant charge, which is located under the pressure plate (not shown in FIG. 6, see FIG. 1); a portion of the gas pressure from this propellant charge is directed through the pressure plate and into the piston sleeve 19, i.e. from below in FIG. 6. Since the piston arrangement has been moved upwards, the detonator fuse 22 and the detonator nose 23 will be exposed in front of the support portion 11. Hitting the ground will initiate ignition by means of the detonator fuse and the detonator nose or, alternatively, by a striking pin hitting a percussion cap, whereby the charge 24 is ignited and an ignition chain is initiated, which proceeds through the channel 25 to the annular space 26. Therefrom the ignition chain proceeds into the support portion 11 through the channel 34 and further to a channel 35, where the ignition chain is split up into two portions. One portion ignites the propellant charge 29 for separating the effective portion 10 from the support portion 11 and propel it up into the air, see FIG. 2. The other portion of the ignition chain ignites the fuse line 16 comprising a delay fuse tube 36 resulting in that an effective charge 37, which is located in the effective portion 10, will not be ignited until later and after the effective portion has left the support portion 11 and is in the air above the shell's position of ground impact.

At the firing of the second propellant charge 29 the effective portion 10 will be blown away from the backing tube 12 resulting in the fin portion 31 also being blown away, whereby the latter will separate from the effective portion immediately when shot upwards from the backing tube 12. Later when the effective portion 10 is in the air, the effective charge 37 will be fired.

Regarding the invention it is to be noted that one of the most important construction components is the backing tube 12. As has been described with reference to FIG. 1 the propellant force from the propellant charge 4 is transmitted directly onto the pressure plate 3 and then directly onto the backing tube 12. This is an important distinction compared with prior art shells; there the shell itself carries the pressure from the propellant charge. The backing tube 12 is rigidly attached to the support portion 11, whereby the propellant force is transmitted to the support portion 11 from the backing tube, and the other portions of the shell are not influenced by the propellant force from the propellant charge and the pressure plate. For that reason it is possible, e.g. to manufacture a shell for training purposes from less expensive and less sophisticated materials, especially the effective portions 10 and fin portion 31 components. It is also to be noted that a ring 40 of suitable material is arranged around the support portion, which ring provides barrel protection and pressure reduction.

In the channel 34 there is shown a locking means, which maintains the plunger 20 in its projecting position. The locking means comprises a tubular pin 41, which is held in an inserted position against the action of the spring force from the spring 42 in the position of the plunger 20 shown in FIG. 5. When the plunger 20 has reached its projecting position the tubular pin 41 enters into the annular space 26, whereby the position of the plunger 20 is locked. It 15 can be seen that the tubular pin 41 is axially hollow, which means that the ignition chain from the annular space 26 can pass to the channel 34 and further into the channel 35.

The shell can be further safety secured by arranging a break pin in apertures provided in the piston sleeve 19 and the backing tube 12.

In an alternative embodiment the detonator nose may include a striking pin located in the nose of the support portion 11. In the upper end, the piston arrangement 18, 19, 20 supports the percussion cap, which is brought into such a position when the shell is fired and the piston arrangement is advanced, that the striking pin hits the percussion cap when the striking pin is pushed into the support portion, when the support portion hits the ground. Before the piston arrangement has been advanced, the striking pin is unable to reach and hit the percussion cap by being pushed inwards.

One of the advantages with the shell according to the invention is that it may be fired from a barrel which is significantly shorter than the barrel used by prior art shells. This is due to the fact that unlike prior art shells the acceleration and the pressure does not come to an end until the shell has left the barrel. When firing prior art shells the pressure and the acceleration come to an end when the sealing of the shell's casing passes the muzzle of the barrel, which occurs 60% earlier than the pressure plate.

What is claimed is:

1. Shell for trench mortars and similar firing systems, which shell includes an effective portion having an effective charge, which effective portion can be shot out from a barrel by a propellant charge, there being a pressure plate provided between the effective portion and the propellant charge, which pressure plate carries the influence from the propellant charge, a support portion being releasably provided in the firing direction in front of the effective portion, the support portion supporting a second propellant charge and in a front end supports a detonator nose, which, when the shell is fired, is brought to an ignitable position in the front end and is ignited when hitting ground initiating the second propellant charge, the second propellant charge being located between the support portion and the effective portion in such a manner, that when the second propellant charge is detonated the effective portion is shot away from the support portion and the effective charge is simultaneously initiated with delay, the support portion being attached to a metal backing tube supporting the effective portion, which is arranged around the backing tube and is axially movable from the support potion against the influence of a locking force, there being provided inside the backing tube an axially movable piston arrangement, which, in an end where the backing tube is attached to the support portion, has a priming tube with a charge and a detonator, which is pointing out from the support portion, the opposite end of the piston arrangement being arranged to be influenced by a small portion of the pressure from the propellant charge acting on the pressure plate when the shell is fired.

2. Shell according to claim 1, wherein the piston arrangement has movement in a direction of motion out from the support portion, which movement is restricted by a shoulder to a position the where the detonator projects in front of the support portion, the piston arrangement having a channel, which in said position communicates said charge of said priming tube with a channel system extending through the support portion to communicate on one hand with the second propellant charge, and on the other hand with the effective charge in the effective portion.

3. Shell according to claim 2, wherein the piston arrangement is provided with said shoulder and moves gas-tightly in a cylinder bore in the support portion, the cylinder bore has a ledge, against which the shoulder abuts in the projecting position of the piston arrangement, the channel of the piston arrangement extends axially from the charge of the priming tube to a transverse channel extending through the piston arrangement, which transverse channel is aligned with an aperture to the channel system of the support portion.

4. Shell according to claim 1, wherein the support portion has a snap-in lock cooperating with the piston arrangement to lock the piston arrangement in its projecting position.

5. Shell according to claim 1, wherein the backing tube abuts the pressure plate directly or indirectly.

6. Shell according to claim 1, wherein the backing tube is attached to the pressure plate by a connector means, which is releasable by gas pressure.

* * * * *